US011390081B2

(12) United States Patent
Chen et al.

(10) Patent No.: US 11,390,081 B2
(45) Date of Patent: Jul. 19, 2022

(54) FLUID EJECTION DEVICE WITH A CARRIER HAVING A SLOT

(71) Applicant: HEWLETT-PACKARD DEVELOPMENT COMPANY, L.P., Spring, TX (US)

(72) Inventors: Chien-Hua Chen, Corvallis, OR (US); Christopher A. Leonard, Corvallis, OR (US); Anthony M. Fuller, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,907

(22) PCT Filed: Feb. 6, 2019

(86) PCT No.: PCT/US2019/016759
§ 371 (c)(1),
(2) Date: Jun. 4, 2020

(87) PCT Pub. No.: WO2020/162907
PCT Pub. Date: Aug. 13, 2020

(65) Prior Publication Data

US 2021/0229438 A1 Jul. 29, 2021

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1637* (2013.01); *B41J 2002/14491* (2013.01)

(58) Field of Classification Search
CPC ..... B41J 2/1433; B41J 2/162; B41J 2/1637
See application file for complete search history.

(56) References Cited

U.S. PATENT DOCUMENTS

| | | | | |
|---|---|---|---|---|
| 7,572,675 | B2 | 8/2009 | Narasimalu et al. | |
| 7,906,837 | B2 | 3/2011 | Cabahug et al. | |
| 2002/0167569 | A1* | 11/2002 | Hosono | B41J 2/14274 347/70 |
| 2006/0114297 | A1 | 6/2006 | Bertelsen et al. | |
| 2009/0096070 | A1 | 4/2009 | Fan et al. | |

(Continued)

FOREIGN PATENT DOCUMENTS

| | | | |
|---|---|---|---|
| CN | 1946556 | A | 4/2007 |
| CN | 101287606 | A | 10/2008 |

(Continued)

*Primary Examiner* — Jason S Uhlenhake
(74) *Attorney, Agent, or Firm* — Dicke, Billig & Czaja, PLLC

(57) ABSTRACT

A fluid ejection device includes a fluid ejection die including a first end portion positioned adjacent a first end of the fluid ejection die, and a fluid ejection portion positioned adjacent the first end portion. The fluid ejection die includes a contact pad positioned in the first end portion, and a fluid actuation device positioned in the fluid ejection portion. A carrier is attached to the fluid ejection die. The carrier includes a slot to provide fluid to the fluid actuation device. The slot extends longitudinally along the fluid ejection portion to a first slot end. A length from the first slot end to the first end of the fluid ejection die is less than 1.5 mm.

12 Claims, 6 Drawing Sheets

(56) References Cited

U.S. PATENT DOCUMENTS

| | | | | |
|---|---|---|---|---|
| 2010/0156989 | A1 | 6/2010 | Petruchik | |
| 2011/0228017 | A1* | 9/2011 | Dyer | B41J 2/14<br>347/85 |
| 2015/0145925 | A1 | 5/2015 | Rivas et al. | |
| 2016/0009082 | A1* | 1/2016 | Chen | B41J 2/1404<br>347/40 |

FOREIGN PATENT DOCUMENTS

| | | | |
|---|---|---|---|
| CN | 102470671 | A | 5/2012 |
| CN | 103826860 | A | 5/2014 |
| CN | 105142908 | A | 12/2015 |
| CN | 105142911 | A | 12/2015 |
| CN | 105793045 | A | 7/2016 |

* cited by examiner

FLUID EJECTION DEVICE WITH A CARRIER HAVING A SLOT

CROSS-REFERENCE TO RELATED APPLICATIONS

This application is a U.S. National Stage Application of PCT Application No. PCT/US2019/016759, filed Feb. 6, 2019, entitled "FLUID EJECTION DEVICE WITH A CARRIER HAVING A SLOT."

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of the present disclosure are directed to a fluid ejection device, and a method of manufacturing a fluid ejection device in a manner that reduces or eliminates the formation of epoxy molding compound (EMC) on contact pads positioned near ends of the fluid ejection die. This unintended EMC formation on the contact pads is referred to as EMC flash. During the process, an upper mold chase is applied to the back-side surface of the fluid ejection die. The EMC is then applied to the fluid ejection die using a transfer molding process. The upper mold chase includes a slot forming feature that covers ink feed holes of the fluid ejection die during the application of the EMC, and defines a slot in the resulting EMC panel for providing fluid to the ink feed holes. The length of the feature of the upper mold chase defines the length of the slot, and this length is less than the length of the fluid ejection die. Reducing the space between an end of the feature and an end of the fluid ejection die can reduce or eliminate EMC flash on the contact pads. In one example, the process results in a fluid ejection device with a length between an end of the slot and an end of the fluid ejection die that is less than 1.5 mm.

Figure 1:
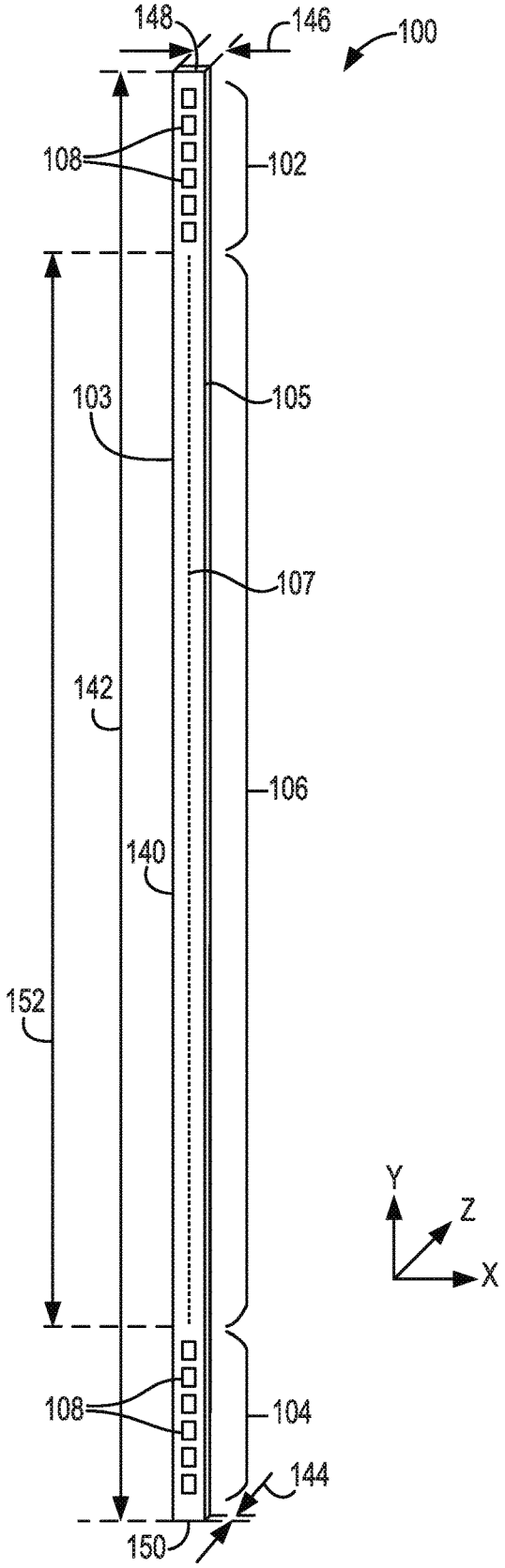
FIG. 1 is a diagram illustrating a fluid ejection die according to one example.

FIG. 1 is a diagram illustrating a fluid ejection die 100 according to one example. Die 100 includes a first longitudinal end portion 102 that includes a plurality (e.g., six in the illustrated example) of contact pads 108, a second longitudinal end portion 104 that includes a plurality (e.g., six in the illustrated example) of contact pads 108, and a fluid ejection portion 106 that includes a plurality of fluid actuation devices 107. The contact pads 108 in the second longitudinal end portion 104 are longitudinally aligned with the contact pads 108 in the first longitudinal end portion 102, and are positioned at a distance 152 (i.e., along the Y axis) from the contact pads 108 in the first longitudinal end portion 102.

The plurality of fluid actuation devices 107 is disposed longitudinally to the contact pads 108 in the first longitudinal end portion 102 and the contact pads 108 in the second longitudinal end portion 104. The plurality of fluid actuation devices 107 is also arranged between the contact pads 108 in the first longitudinal end portion 102 and the contact pads 108 in the second longitudinal end portion 104. In the illustrated example, the contact pads 108 in the first longitudinal end portion 102, the contact pads 108 in the second longitudinal end portion 104, and the plurality of fluid actuation devices 107 are each arranged in a column, and the three columns are longitudinally aligned (i.e., not laterally offset from one another). In one example, fluid actuation devices 107 are nozzles or fluidic pumps to eject fluid drops.

Die 100 includes an elongate semiconductor (e.g., silicon) substrate 140 having a length 142 (along the Y axis) between lateral ends 148 and 150, a thickness 144 (along the Z axis), and a width 146 (along the X axis) between lateral ends 103 and 105 of the die 100. In one example, the length 142 is at least twenty times the width 146. The width 146 may be 1 mm or less and the thickness 144 may be less than 500 microns. The fluid actuation devices 107 and the contact pads 108 are provided on the elongate substrate 140 and are arranged along the length 142 of the elongate substrate. The fluid actuation devices 107 have a swath length 152 less than the length 142 of the elongate substrate 140. In one example, the swath length 152 is at least 1.2 cm. The contact pads 108 in the first longitudinal end portion 102 may be arranged near a first longitudinal end 148 of the elongate substrate 140. The contact pads 108 in the second longitudinal end portion 104 may be arranged near a second longitudinal end 150 of the elongate substrate 140 opposite to the first longitudinal end 148.

Figure 2:
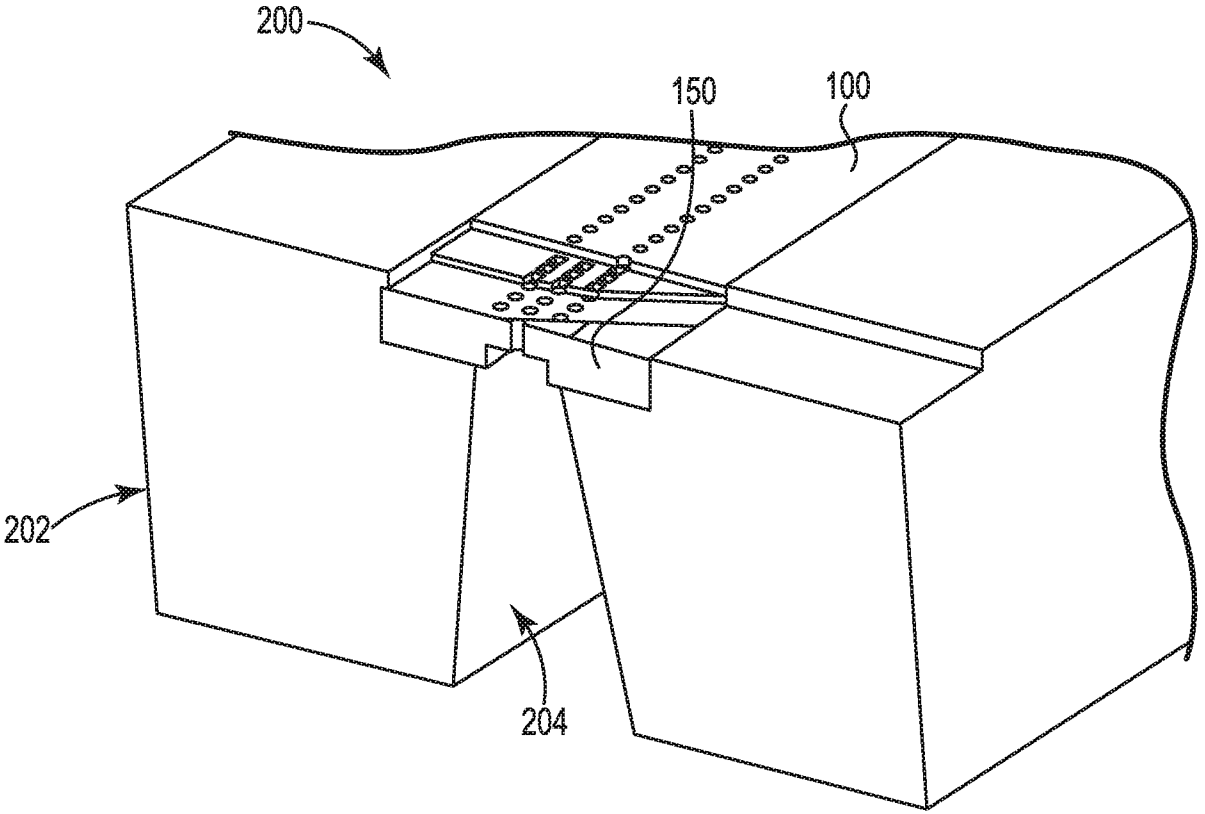
FIG. 2 is a diagram illustrating a fluid ejection device according to one example.

FIG. 2 is a diagram illustrating a fluid ejection device 200 according to one example. Fluid ejection device 200 includes a fluid ejection die 100 attached to a carrier 202. In one example, the carrier 202 is a rigid, molded carrier that is formed by a transfer molding processes. A slot 204 is formed in the carrier 202 to provide fluid to the back side of the fluid ejection die 100. In one example, the slot 204 extends longitudinally along the fluid ejection die 100, and is longitudinally aligned (i.e., not laterally offset) with the plurality of fluid actuation devices 107 (FIG. 1).

Figure 3C:
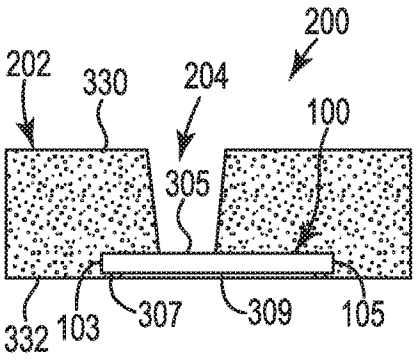
FIGS. 3A-3C are diagrams illustrating a method of forming the fluid ejection device shown in FIG. 2 according to one example.
Figure 3B:
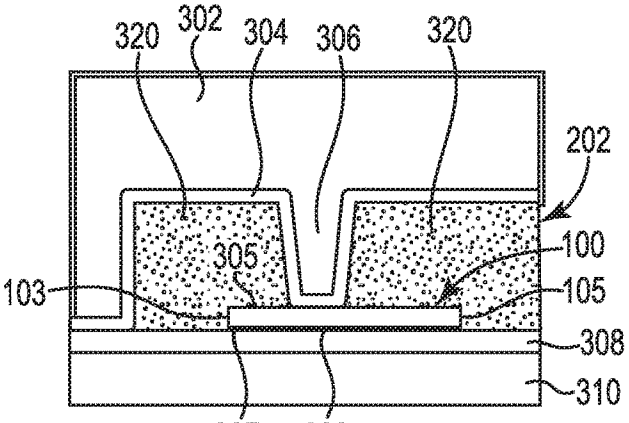
Figure 3A:
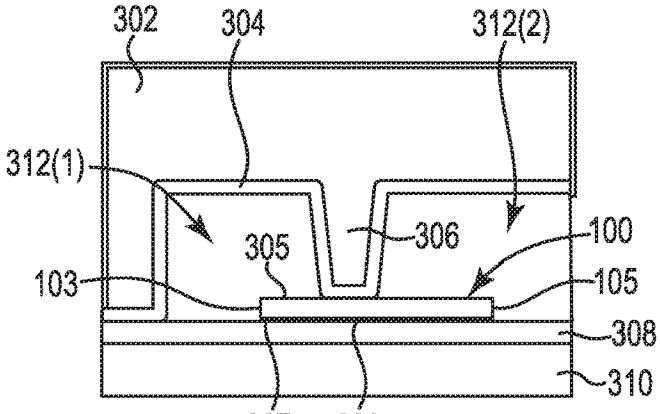

FIGS. 3A-3C are diagrams illustrating a method of forming the fluid ejection device 200 shown in FIG. 2 according to one example. As shown in FIG. 3A, fluid ejection die 100 is positioned on a release tape layer 308, which is positioned on a die carrier 310. More specifically, fluid ejection die 100 is positioned with a front-side surface 307 facing the release tape layer 308 and the die carrier 310. A nozzle layer 309 is formed on the front-side surface 307 of the fluid ejection die 100. Upper mold chase 302 is positioned over fluid ejection die 100 (and die carrier 310). More specifically, upper mold chase 302 is positioned over fluid ejection die 100 with back-side surface 305 of fluid ejection die 100 facing upper mold chase 302. Upper mold chase 302 includes a slot forming feature 306 that seals fluid feed holes formed in fluid ejection die 100 to protect the fluid feed holes during molding. Upper mold chase 302 includes a bottom surface that defines cavities 312(1) and 312(2) (collectively referred to as cavities 312) between upper mold chase 302 and die carrier 310.

In one example, a release liner 304 is positioned along the bottom surface of upper mold chase 302 so as to be positioned between fluid ejection die 100 and upper mold chase 302. Release liner 304 helps to prevent contamination of upper mold chase 302 and minimize flash during the molding process.

As shown in FIG. 3B, cavities 312 are filled with mold material 320, such as an epoxy mold compound, plastic, or other suitable moldable material. Filling cavities 312 with mold material 320 forms a carrier 202 around fluid ejection die 100. In one example, the molding process is a transfer molding process and includes heating the mold material 320 to a liquid form and injecting or vacuum feeding the liquid mold material into cavities 312 (for example, through runners that communicate with cavities 312). The feature 306 of the upper mold chase 302 (as positioned along back-side surface 305 of fluid ejection die 100) helps to prevent the mold material from entering the fluid feed holes of die 100 as cavities 312 are filled.

As shown in FIG. 3C, after the mold material cools and hardens to a solid, upper mold chase 302 and liner 304 are removed, and fluid ejection die 100 and carrier 202 are removed or released from die carrier 310. Thus, carrier 202 is molded to include molded back-side surface 330 and molded front-side surface 332, with molded front-side surface 332 substantially coplanar with front-side surface 307 of fluid ejection die 100, and molded back-side surface 330 extending beyond back-side surface 305 of fluid ejection die 100. As such, carrier 202 has a thickness that is greater than the thickness of fluid ejection die 100. In addition, front-side surface 307 of fluid ejection die 100 and a portion of back-side surface 305 of fluid ejection die 100 both remain exposed from carrier 202 (i.e., are not covered by mold material of carrier 202). While one fluid ejection die 100 is illustrated in FIGS. 3A-3C as being molded into carrier 202, a greater number of fluid ejection dies 100 may be molded into carrier 202.

The shape of the slot 204 is usually a result of particular slotting process (e.g., laser, anisotropic wet etch, dry etch, or a combination of these), and these processes may have a limited influence on the profile of the slot 204 that can be produced. Examples disclosed herein enable a transfer mold process with slot molding by reducing or eliminating the contact pad EMC flash issue, as described in further detail below.

Figure 4:
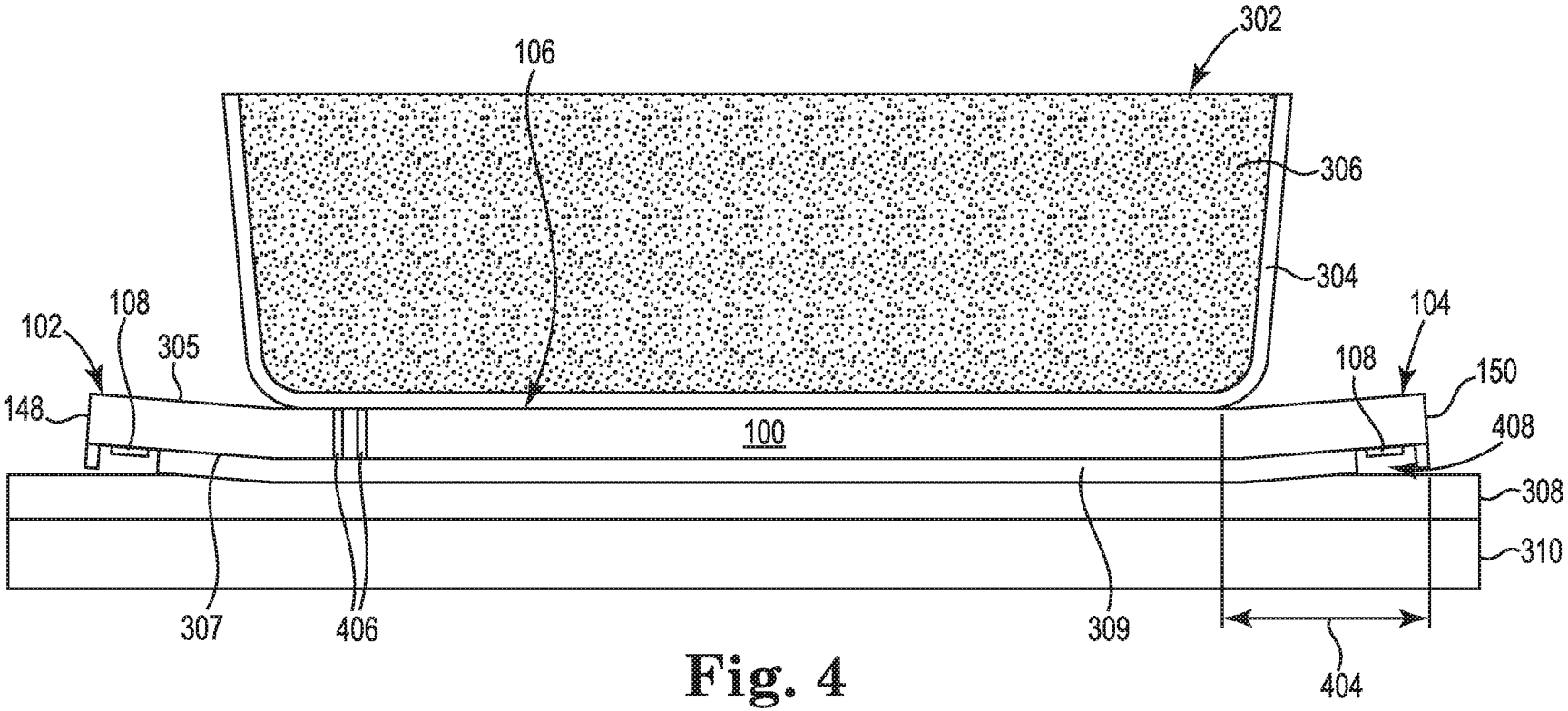
FIG. 4 is a diagram illustrating the application of an upper mold chase to a fluid ejection die according to one example.

FIG. 4 is a diagram illustrating the application of an upper mold chase 302 to a fluid ejection die 100 according to one example. As shown in FIG. 4, a nozzle layer 309 is formed on the front-side surface 307 of the fluid ejection die 100, and the die 100 and the nozzle layer 309 are positioned on a release tape layer 308. The release tape layer 308 is positioned on die carrier 310. Feature 306 of upper mold chase 302 is positioned over fluid ejection die 100 with back-side surface 305 of fluid ejection die 100 facing feature 306. A plurality of fluid feed holes 406 extend through the fluid ejection die 100. Although two fluid feed holes 406 are shown in FIG. 4 to simplify the Figure, the fluid ejection die 100 may include more or less than two fluid feed holes 406, and the fluid feed holes 406 may be positioned across the length of the fluid ejection portion 106 of the die 100. The feature 306 seals the fluid feed holes 406 formed in fluid ejection die 100 to protect the fluid feed holes 406 during molding. Release liner 304 is positioned along the bottom surface of feature 306 so as to be positioned between fluid ejection die 100 and feature 306.

One challenge in the slot molding process is keeping the contact pads 108 at the longitudinal ends 148 and 150 of the die 100 free from the EMC flash. The fluid ejection die 100 sits on top of the release tape layer 308, which, in one example, is a compliant layer that is about 100 um thick. The feature 306 of the upper mold chase 302 contacts and applies force to the fluid ejection portion 106 of the fluid ejection die 100, but not the end portions 102 and 104 of the die 100. This force can cause the fluid ejection portion 106 of the die 100 to sink into the release tape layer 308, and cause the end portions 102 and 104 to tilt up toward the upper mold chase 302 during the molding process. This tilting can cause a gap 408 that results in EMC flash in the regions of the contact pads 108.

The length 404 between the end of the feature 306 and the end 150 of the die 100 is referred to herein as the cantilever length, which plays a role in addressing the contact pad EMC flash issue. Examples of the present disclosure use a short cantilever length 404 to reduce or eliminate the contact pad EMC flash issue. In one example, one or both of the end portions 102 and 104 have a cantilever length 404 that is less than 1.5 mm. In another example, one or both of the end portions 102 and 104 have a cantilever length 404 that is less than 1.3 mm. In yet another example, one or both of the end portions 102 and 104 have a cantilever length 404 that is less than 1.1 mm.

Figure 7:
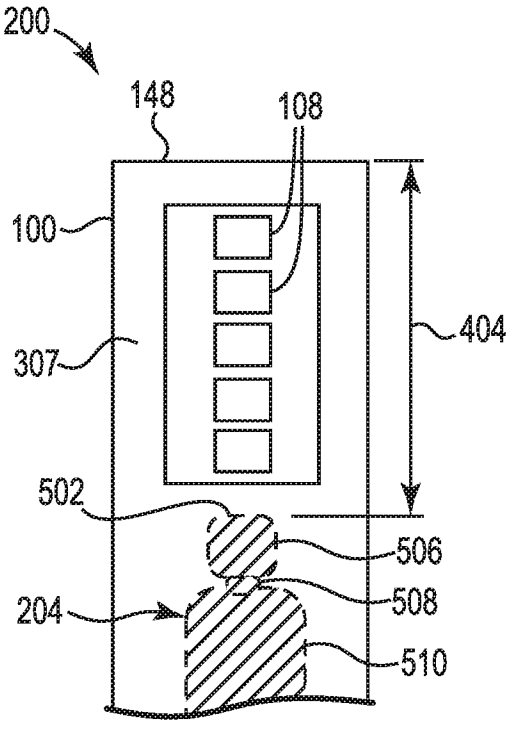
FIGS. 5-7 are diagrams illustrating a top view of a portion of the fluid ejection device shown in FIG. 2 according to one example.
Figure 6:
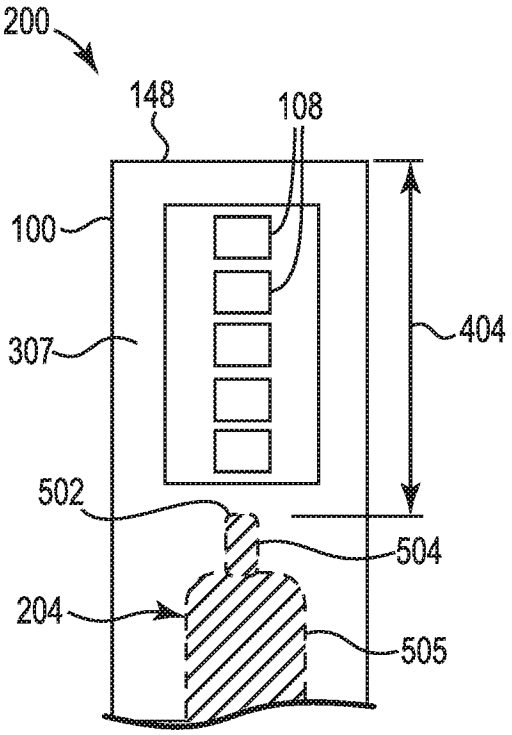
Figure 5:
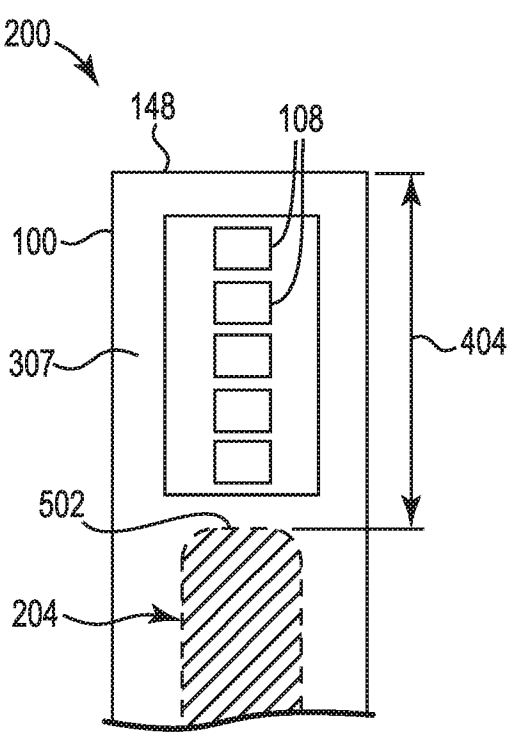

FIGS. 5-7 are diagrams illustrating a top view of a portion of the fluid ejection device 200 shown in FIG. 2 according to one example. As shown in FIG. 5, contact pads 108 are positioned on the front side 307 of the die 100. Slot 204 is positioned on the back side 305 of the die, and is, therefore, shown with dashed lines in FIG. 5. The slot 204 has a uniform width or a substantially uniform width along its length. The length between the longitudinal end 148 of the die and the longitudinal end 502 of the slot 204 defines the cantilever length 404.

Extending the length of the feature 306 (FIG. 4) of the upper mold chase 302 results in an increase in the slot length of the slot 204 and a reduction in the cantilever length 404. Increasing the slot length helps to reduce or eliminate the contact pad EMC flash issue. However, increasing the slot length may result in an increase in the distance between the longitudinal end 502 of the slot 204 and the fluid actuation device 107 (FIG. 1) that is closest to the end 502. This portion of the slot 204 that extends beyond that fluid actuation device 107 may be referred to herein as dead space, since there are no fluid actuation devices 107 positioned directly above that space. Some examples of the present disclosure modify the shape of the slot 204 near the longitudinal end 502 to reduce the volume of the dead space. Two such examples are shown in FIGS. 6 and 7 and described below.

As shown in FIG. 6, the slot 204 includes a narrower slot portion 504 longitudinally extending from a wider slot portion 505 near the longitudinal end 502 of the slot 204. The narrower slot portion 504 has a uniform width or a substantially uniform width that is less than a uniform width or substantially uniform width of the wider slot portion 505. In one example, the width of the narrower slot portion 504 is about 25-35% of the width of the wider slot portion 505. In one example, there are no fluid actuation devices 107 positioned directly above (i.e., along the Z axis in FIG. 1) the narrower slot portion 504.

As shown in FIG. 7, the slot 204 includes slot portion 508 longitudinally extending from slot portion 510, and slot portion 506 longitudinally extending from slot portion 508 near the longitudinal end 502 of the slot 204. Slot portions 506 and 508 each have a uniform width or a substantially uniform width that is less than a uniform width or substantially uniform width of the slot portion 510. In one example, the width of the slot portion 508 is about 25-35% of the width of the slot portion 510, and the width of the slot portion 506 is about 40-60% of the width of the slot portion 510. In one example, there are no fluid actuation devices 107 positioned directly above (i.e., along the Z axis in FIG. 1) the slot portions 506 and 508.

Figure 8:
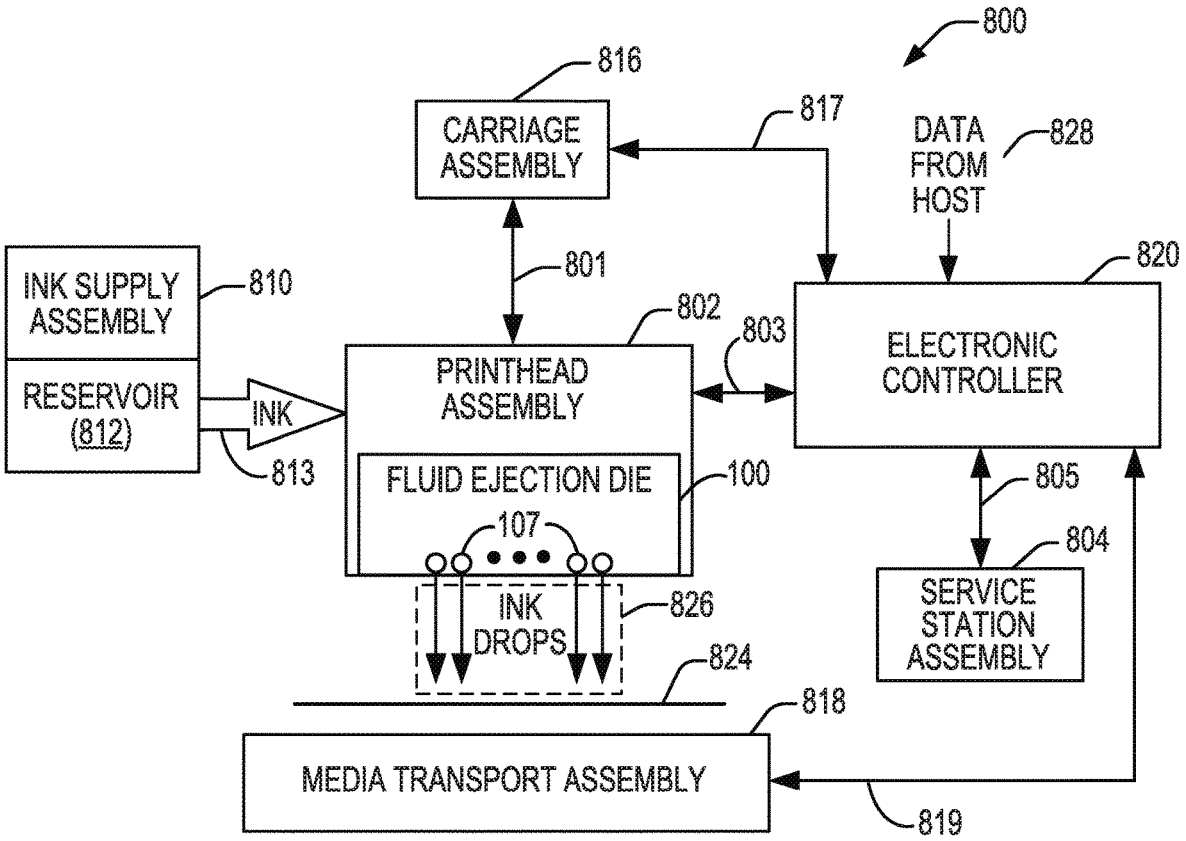
FIG. 8 is a block diagram illustrating a fluid ejection system according to one example.

FIG. 8 is a block diagram illustrating a fluid ejection system 800 according to one example. Fluid ejection system 800 includes a fluid ejection assembly, such as printhead assembly 802, and a fluid supply assembly, such as ink supply assembly 810. In one example, printhead assembly 802 may include a fluid ejection device 200 of FIG. 2. In the illustrated example, fluid ejection system 800 also includes a service station assembly 804, a carriage assembly 816, a print media transport assembly 818, and an electronic controller 820. While the following description provides examples of systems and assemblies for fluid handling with regard to ink, the disclosed systems and assemblies are also applicable to the handling of fluids other than ink.

Printhead assembly 802 includes at least one printhead or fluid ejection die 100 previously described and illustrated with reference to FIG. 1, which ejects drops of ink or fluid through a plurality of orifices or nozzles 107. In one example, the drops are directed toward a medium, such as print media 824, so as to print onto print media 824. In one example, print media 824 includes any type of suitable sheet material, such as paper, card stock, transparencies, Mylar, fabric, and the like. In another example, print media 824 includes media for three-dimensional (3D) printing, such as a powder bed, or media for bioprinting and/or drug discovery testing, such as a reservoir or container. In one example, nozzles 107 are arranged in at least one column or array such that properly sequenced ejection of ink from nozzles 107 causes characters, symbols, and/or other graphics or images to be printed upon print media 824 as printhead assembly 802 and print media 824 are moved relative to each other.

Ink supply assembly 810 supplies ink to printhead assembly 802 and includes a reservoir 812 for storing ink. As such, in one example, ink flows from reservoir 812 to printhead assembly 802. In one example, printhead assembly 802 and ink supply assembly 810 are housed together in an inkjet or fluid-jet print cartridge or pen. In another example, ink supply assembly 810 is separate from printhead assembly 802 and supplies ink to printhead assembly 802 through an interface connection 813, such as a supply tube and/or valve.

Carriage assembly 816 positions printhead assembly 802 relative to print media transport assembly 818, and print media transport assembly 818 positions print media 824 relative to printhead assembly 802. Thus, a print zone 826 is defined adjacent to nozzles 107 in an area between printhead assembly 802 and print media 824. In one example, printhead assembly 802 is a scanning type printhead assembly such that carriage assembly 816 moves printhead assembly 802 relative to print media transport assembly 818. In another example, printhead assembly 802 is a non-scanning type printhead assembly such that carriage assembly 816 fixes printhead assembly 802 at a prescribed position relative to print media transport assembly 818.

Service station assembly 804 provides for spitting, wiping, capping, and/or priming of printhead assembly 802 to maintain the functionality of printhead assembly 802 and, more specifically, nozzles 107. For example, service station assembly 804 may include a rubber blade or wiper which is periodically passed over printhead assembly 802 to wipe and clean nozzles 107 of excess ink. In addition, service station assembly 804 may include a cap that covers printhead assembly 802 to protect nozzles 107 from drying out during periods of non-use. In addition, service station assembly 804 may include a spittoon into which printhead assembly 802 ejects ink during spits to ensure that reservoir 812 maintains an appropriate level of pressure and fluidity, and to ensure that nozzles 107 do not clog or weep. Functions of service station assembly 804 may include relative motion between service station assembly 804 and printhead assembly 802.

Electronic controller 820 communicates with printhead assembly 802 through a communication path 803, service station assembly 804 through a communication path 805, carriage assembly 816 through a communication path 817, and print media transport assembly 818 through a communication path 819. In one example, when printhead assembly 802 is mounted in carriage assembly 816, electronic controller 820 and printhead assembly 802 may communicate via carriage assembly 816 through a communication path 801. Electronic controller 820 may also communicate with ink supply assembly 810 such that, in one implementation, a new (or used) ink supply may be detected.

Electronic controller 820 receives data 828 from a host system, such as a computer, and may include memory for temporarily storing data 828. Data 828 may be sent to fluid ejection system 800 along an electronic, infrared, optical or other information transfer path. Data 828 represent, for example, a document and/or file to be printed. As such, data 828 form a print job for fluid ejection system 800 and includes at least one print job command and/or command parameter.

In one example, electronic controller 820 provides control of printhead assembly 802 including timing control for ejection of ink drops from nozzles 107. As such, electronic controller 820 defines a pattern of ejected ink drops which form characters, symbols, and/or other graphics or images on print media 824. Timing control and, therefore, the pattern of ejected ink drops, is determined by the print job commands and/or command parameters. In one example, logic and drive circuitry forming a portion of electronic controller 820 is located on printhead assembly 802. In another example, logic and drive circuitry forming a portion of electronic controller 820 is located off printhead assembly 802.

Examples disclosed herein provide the following features: (1) Enable the use of a slot molding process by reducing or eliminating the contact pad EMC flash issue; (2) use a robust mold process that is less sensitive to slot misalignment; (3)

eliminate the silicon slotting process, which reduces the die cost; (4) minimize die cracking by avoiding mechanical/laser damage to the silicon; and (5) superior slot sidewall quality/smoothness to avoid particle shedding issues.

One example of this disclosure is directed to a fluid ejection device, which includes a fluid ejection die including a first end portion positioned adjacent a first end of the fluid ejection die, and a fluid ejection portion positioned adjacent the first end portion. The fluid ejection die includes a contact pad positioned in the first end portion, and a fluid actuation device positioned in the fluid ejection portion. A carrier is attached to the fluid ejection die. The carrier includes a slot to provide fluid to the fluid actuation device. The slot extends longitudinally along the fluid ejection portion to a first slot end. A length from the first slot end to the first end of the fluid ejection die is less than 1.5 mm.

The first end may be a first longitudinal end of the fluid ejection die. The length from the first slot end to the first end of the fluid ejection die may be less than 1.3 mm. The length from the first slot end to the first end of the fluid ejection die may be less than 1.1 mm. The slot may decrease in width from a first width along the fluid ejection portion to a second, smaller width along an end portion of the slot adjacent the first slot end. The fluid ejection die may include a second end portion positioned adjacent a second end of the fluid ejection die. The fluid ejection die may include a contact pad positioned in the second end portion. The slot may extend longitudinally along the fluid ejection portion to a second slot end. A length from the second slot end to the second end of the fluid ejection die may be less than 1.5 mm. The second end may be a second longitudinal end of the fluid ejection die. The carrier may be a rigid carrier. The carrier may be a molded carrier, and the slot may be a molded slot.

Another example of this disclosure is directed to a fluid ejection device, which includes a fluid ejection die including a first end portion positioned adjacent a first end of the fluid ejection die, a second end portion positioned adjacent a second end of the fluid ejection die, and a fluid ejection portion positioned between the first and second end portions. The fluid ejection die includes a fluid actuation device positioned in the fluid ejection portion. A rigid carrier is attached to the fluid ejection die. The rigid carrier includes a slot to provide fluid to a back side of the fluid ejection die. The slot extends longitudinally along the fluid ejection portion to a first slot end adjacent the first end portion. A length from the first slot end to the first end of the fluid ejection die is less than 1.5 mm.

The fluid ejection die may include a first contact pad positioned in the first end portion, and a second contact pad positioned in the second end portion. The slot may extend longitudinally along the fluid ejection portion to a second slot end adjacent the second end portion, and a length from the second slot end to the second end of the fluid ejection die may be less than 1.5 mm.

Yet another example of this disclosure is directed to a method, which includes applying a mold chase to a fluid ejection die, wherein the mold chase at least partially defines at least one cavity, and wherein the mold chase includes a slot forming feature having a first longitudinal end positioned less than 1.5 mm from a first longitudinal end of the fluid ejection die. The method includes filling the at least one cavity with a mold compound to generate a carrier to support the fluid ejection die, wherein the carrier includes a slot defined by the slot forming feature.

The slot forming feature may cover fluid feed holes of the fluid ejection die. The slot forming feature may have a second longitudinal end positioned less than 1.5 mm from a second longitudinal end of the fluid ejection die.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device, comprising:

a fluid ejection die including a first end portion positioned adjacent a first end of the fluid ejection die, and a fluid ejection portion positioned adjacent the first end portion and extending from the first end portion along an axis, wherein the fluid ejection die includes a contact pad positioned in the first end portion, and a fluid actuation device positioned in the fluid ejection portion; and a carrier attached to the fluid ejection die, wherein the carrier includes a slot to provide fluid to the fluid actuation device, wherein the slot extends longitudinally along the axis and the fluid ejection portion to a first slot end, and wherein a length along the axis from the first slot end to the first end of the fluid ejection die is less than 1.5 mm.

2. The fluid ejection device of claim 1, wherein the first end is a first longitudinal end of the fluid ejection die.

3. The fluid ejection device of claim 1, wherein the length from the first slot end to the first end of the fluid ejection die is less than 1.3 mm.

4. The fluid ejection device of claim 1, wherein the length from the first slot end to the first end of the fluid ejection die is less than 1.1 mm.

5. The fluid ejection device of claim 1, wherein the slot decreases in width from a first width along the fluid ejection portion to a second, smaller width along an end portion of the slot adjacent the first slot end.

6. The fluid ejection device of claim 1, wherein the fluid ejection die includes a second end portion positioned adjacent a second end of the fluid ejection die, wherein the fluid ejection die includes a contact pad positioned in the second end portion, wherein the slot extends longitudinally along the fluid ejection portion to a second slot end, and wherein a length from the second slot end to the second end of the fluid ejection die is less than 1.5 mm.

7. The fluid ejection device of claim 6, wherein the second end is a second longitudinal end of the fluid ejection die.

8. The fluid ejection device of claim 1, wherein the carrier is a rigid carrier.

9. The fluid ejection device of claim 1, wherein the carrier is a molded carrier, and the slot is a molded slot.

10. A fluid ejection device, comprising:

a fluid ejection die including a first end portion positioned adjacent a first end of the fluid ejection die, a second end portion positioned adjacent a second end of the fluid ejection die, and a fluid ejection portion extending along an axis between the first and second end portions, wherein the fluid ejection die includes a fluid actuation device positioned in the fluid ejection portion; and a rigid carrier attached to the fluid ejection die, wherein the rigid carrier includes a slot to provide fluid to a back side of the fluid ejection die, wherein the slot extends longitudinally along the axis and the fluid ejection portion to a first slot end adjacent the first end portion, and wherein a length along the axis from the first slot end to the first end of the fluid ejection die is less than 1.5 mm.

11. The fluid ejection device of claim 10, wherein the fluid ejection die includes a first contact pad positioned in the first end portion, and a second contact pad positioned in the second end portion.

12. The fluid ejection device of claim 10, wherein the slot extends longitudinally along the fluid ejection portion to a second slot end adjacent the second end portion, and wherein a length from the second slot end to the second end of the fluid ejection die is less than 1.5 mm.

* * * * *